US005189975A

United States Patent [19]

Zednik et al.

[11] Patent Number: 5,189,975

[45] Date of Patent: Mar. 2, 1993

[54] METHOD FOR RECONFIGURATION TANKERS

[75] Inventors: Jay J. Zednik, Oakton, Va.; Paul C. Dahan, Pittstown, N.J.

[73] Assignee: Mobil Oil Corporation, Fairfax, Va.

[21] Appl. No.: 877,501

[22] Filed: May 1, 1992

[51] Int. Cl.[5] ..... B23K 31/00

[52] U.S. Cl. ..... 114/74 A; 114/74 R

[58] Field of Search ..... 114/65 R, 72–74 R, 114/74 A, 76–78 R, 79 W, 121, 125, 256; 29/402.01, 402.03, 402.04, 402.05, 402.06, 402.07, 469

[56] References Cited

U.S. PATENT DOCUMENTS

| | | | |
|---|---|---|---|
| 3,399,645 | 9/1968 | Dahan | 114/74 |
| 3,631,832 | 1/1972 | Rodriguez | 114/74 R |
| 3,797,099 | 3/1974 | Myers | 114/74.1 |
| 3,938,457 | 2/1976 | Dwyer | 114/74 R |
| 4,207,827 | 6/1980 | Gondouini | 114/74 A |
| 4,341,175 | 7/1982 | Ivanov | 114/74 R |

*Primary Examiner*—Joseph F. Peters, Jr.
*Assistant Examiner*—Clifford T. Bartz
*Attorney, Agent, or Firm*—Alexander J. McKillop; Charles J. Speciale; George W. Hager, Jr.

[57] ABSTRACT

A method for converting a single-hull tanker to a mid-deck configuration is disclosed. The midship cargo section of the tanker is cut longitudinally along a horizontal plane well below the normal laden water line. A spacer member including a new transverse mid-deck is interposed between the lower and upper portions of the midship cargo section. The port and starboard outer sections of the midship cargo section of the vessel are cut longitudinally away from the central portions of the midship sections of the vessel, and new longitudinal bulkheads are added. In this way the vessel is provided with port and starboard wing ballast tanks between the hull plating and the port and starboard wing cargo tanks. The center cargo tank is also divided the upper and lower sections, such that the lower section can be converted to ballast in the event double-hulled tankers become mandatory for oil transport.

14 Claims, 6 Drawing Sheets

63
72
76
70
80
61
66
60
64
62
67
69
73
68
110
112
30
28
20
102
23
21
25
24
26
22
100

METHOD FOR RECONFIGURATION TANKERS

BACKGROUND OF THE INVENTION

1. Field of the Invention

This invention relates to a method of reconfiguring an oil tanker. More particularly, this invention relates to a method whereby a standard single hull tanker can be converted into a so-called mid-deck tanker in order to limit the quantity of oil spilled in the event of a collision or grounding.

2. Description of the Prior Art

Increasing public awareness of the fragile nature of the Earth's environment coupled with seeming increase in the number of oil tanker accidents has resulted in substantial world wide attention to safe transport of oil in tankers, that is, in specialized ocean going ships carrying extremely large amounts of crude oil from production locations such as the Middle East to refinery locations such as in the United States.

In the past, oceanic shipment of oil has been made in single hull tankers, in which the midship cargo section (that is, located in the middle part of the hull) of the tanker is divided by longitudinal and transverse bulkheads into a series of port and starboard wing tanks and center tanks. The outer hull plating of the ship forms the outer shell of the wing tanks. Similarly, the bottom plating forms the lower shell of the central tanks. Thus, no ballast tanks, void spaces or the like are present between the hull plating and the tanks containing the oil. The obvious defect of such "single-hull" tankers is that any damage to the hull will typically cause the oil in the corresponding tanks to be released, possibly causing damage to coastlines, wildlife, and fisheries.

In this connection it is sometimes argued that oil carried in a tanker holed in an accident will not necessarily drain out of a punctured tank, because the oil, being lighter than water, will float. However, it will be appreciated that tankers are most commonly holed by running aground. This typically occurs near harbors, shorelines, or the like where there are usually substantial currents and tides. The action of tidal or current flow past an open puncture in an oil tank causes sufficient turbulence to pull the oil out of the tank, despite the fact that the oil is lighter than water.

Therefore, the public has recognized, as has the art, that improvements in tanker design are necessary to eliminate or limit as much as practical the risk of oil pollution caused by tanker accidents.

FIG. 1 shows an exemplary cross-sectional view through the midship cargo section of a typical single-hull tanker, looking forward. As there shown, the midship section is defined by port outer plating 20, starboard outer plating 22, a port longitudinal bulkhead 24, a starboard longitudinal bulkhead 26, hull bottom plating 28, and deck plating 30. Evidently, if the hull bottom plating 28, for example, is pierced by running the tanker aground, oil in the tank including that portion of the hull bottom plating 28 can leak out.

Accordingly, there have been built so-called "double-hull" tankers as depicted in schematic cross-sectional midship view in FIG. 3, again looking forward. There the outer hull plating includes port outer plating 32, starboard outer plating 34, hull bottom plating 36, and deck plating 38, all essentially in as the case of the single-hull tanker of FIG. 1. In this case, however, the port and starboard longitudinal bulkheads, 40 and 42 respectively, do not extend to the hull bottom plating 36 but terminate in a horizontal mid-deck 44 extending laterally between a outer port longitudinal bulkhead 46 and a outer starboard longitudinal bulkhead 48. Thus the midship section of the double-hull tanker of FIG. 3 includes a port wing cargo tank 50, a center cargo tank 52, and a starboard wing cargo tank 54; these cargo tanks are separated from the corresponding sections of the hull plating 32, 34 and 36 by ballast tanks 56 and 58. Ballast tanks 56 and 58 are normally filled with seawater when the oil tanks 50, 52 and 54 are empty, e.g., during a return voyage, and are emptied when the oil tanks are filled for an outbound voyage. In this way the vessel's draft and trim are maintained appropriately.

Segregation of the cargo tanks from the ballast tanks according to the double-hulled tanker design has many significant advantages. A severe impact can be absorbed without puncturing an inner cargo tank, due to the substantial distance between the outer hull plating and the cargo tanks. Moreover, by thus segregating the ballast and oil tanks, ballast water can be pumped into and subsequently removed from the ballast tanks without becoming contaminated with oil. This eliminates the problem of oil mixing with ballast water. By comparison, commonly some of the cargo tanks of a single-hull tanker are filled with ballast water during the return voyage, to maintain the trim of the vessel. When the ballast is subsequently pumped out to accept further oil for a subsequent outbound voyage, as has been common practice, substantial pollution may result, as the ballast water tends to become contaminated with residual oil in the tanks.

Despite its advantages (and certain presently contemplated international regulations), the double-hulled tanker design has not yet been accepted universally by the oil transport industry, principally because for a given deadweight a double-hulled tanker's cargo capacity is marginally less than that of a single-hull tanker, while the cost of the double-hulled tanker is marginally greater. In particular, substantial tonnage of single-hull tankers is now in service. The owners of these ships clearly do not wish to scrap these tankers and will not replace them with costly double-hulled tankers unless they are obliged to do so. To date no effective international organization or government has made double-hulled tankers mandatory.

The art is also aware of a so-called "mid-deck" tanker design shown in midships cross-sectional view in FIG. 2, again looking forward. The mid-deck tanker is comparable to the double-hulled tanker of FIG. 3 in that wing cargo tanks 60 and 62 on either side of central cargo tanks 64 are spaced from the outer hull plating 66 and 68 by ballast tanks 70 and 72 extending into the chines of the vessel. However, the central portion of bottom plating 61 of the mid-deck tanker still forms the outer shell of a lower central cargo tank 78. The "mid-deck" characterization of the tanker of FIG. 2 is due to the presence of a mid-deck 80 dividing the upper and lower central tanks 64 and 78. Perforated extensions 82 and 84 of the mid-deck 80 may also be provided.

The advantage of the mid-deck tanker design of FIG. 2 as compared to the full double-hulled design of FIG. 3 is that a mid-deck tanker of particular dead weight has increased cargo carrying capacity since the lower central tank 78 contains cargo rather than ballast. Moreover, the mid-deck tanker can be effectively converted to a double-hulled tanker simply by carrying ballast rather than oil in the central lower tank 78, should international shipping regulations someday so require. As compared to the single-hull tanker of FIG. 1, the mid-deck tanker of FIG. 2 provides substantially increased protection against accidental oil spills, since the wing ballast tanks 70 and 72 would absorb most impacts; that is, it is found that most accidents cause damage to the outer hull plating 66 or 68 or the plating of the chines, rather to the central bottom plating. Further, the presence of the mid-deck 80 dividing the central tank into upper and lower sections 64 and 78 limits the amount of oil spilled if the bottom plating is holed. Thus for a given amount of hull damage the mid-deck tanker of FIG. 2 will spill less oil than a single-hull tanker as in FIG. 1.

As indicated above, there is a substantial possibility that governmental or international regulation may shortly outlaw single-hull tankers as in FIG. 1. This would require the owners of those tankers to scrap them within some fixed period of time and replace them with the double-hulled tankers of FIG. 3 in order to remain in the oil shipping business. Interim regulations may allow the use of mid-deck tankers for oil transport. It would be advantageous to provide a method whereby such single-hull tankers could be economically reconfigured as safer vessels, thus extending their useful life at reasonable expense, while serving the end of reducing oil pollution caused by tanker collisions or accidental groundings.

OBJECTS AND SUMMARY OF THE INVENTION

It is therefore an object of the invention to provide a method whereby a conventional single-hull tanker can be economically reconfigured to mid-deck configuration, that is, to include additional longitudinal bulkheads between the original longitudinal bulkheads and the outer hull plating, and an additional mid-deck, forming segregated ballast tanks outboard of and beneath the wing tanks, to reduce the likelihood of an oil spill occurring upon collision or accidental grounding of the reconfigured tanker, and to limit the oil spilled in any given incident.

This object of the invention and others which will appear as the discussion below proceeds are satisfied by the present invention, according to which the midship cargo section of a single-hull tanker is cut apart longitudinally along a horizontal line, below the laden water line of the tanker. The horizontal cutting line extends through the outer hull plating, the longitudinal bulkheads and the transverse bulkheads. A new mid-deck is added several meters above the keel portion of the hull, typically extending transversely between the port and starboard outer plating. The new mid-deck defines chine tanks used for ballast when the tanker is empty of cargo, or pumped empty of ballast when the tanker is loaded, so that a collision or grounding causing damage to the hull plating of the tanker in the chine portions is unlikely to open a cargo tank. In a preferred embodiment of the invention, the transverse bulkheads are also cut vertically, together with any web bracing in the wing tanks, and additional longitudinal bulkheads are welded therein, thus defining inner cargo and outer ballast wing tanks. In this way the wing cargo tanks are spaced substantially from the port and starboard outer hull plating so that damage to the outer hull plating is unlikely to puncture the wing cargo tanks. By addition of the new mid-deck, a lower central tank is also provided, which may be employed for ballast exclusively in the event international regulations or the like make double-hulled tankers imperative.

BRIEF DESCRIPTION OF THE DRAWINGS

The invention will be better understood if reference is made to the accompanying drawings, in which.

DESCRIPTION OF THE PREFERRED EMBODIMENTS

Figure 1:
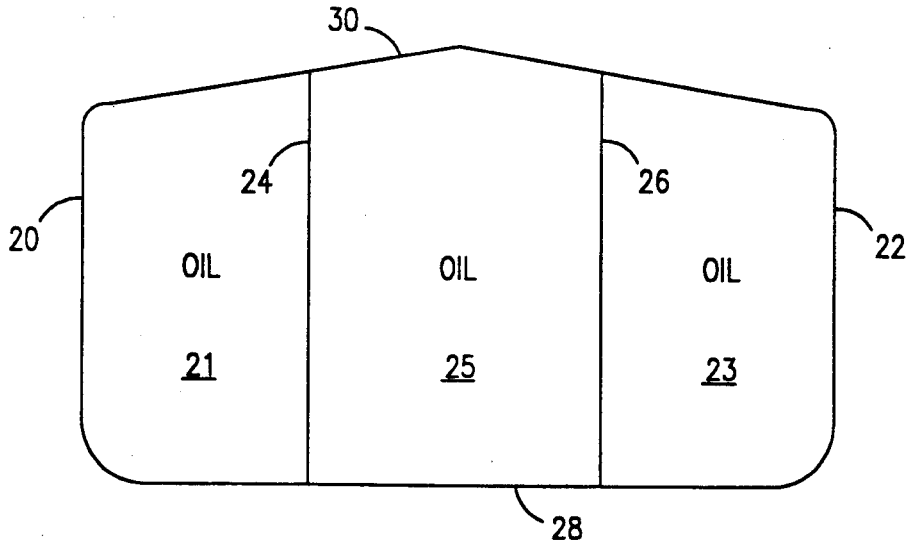
FIG. 1 is a simplified cross-sectional view of the midship cargo section of a conventional single-hull tanker, looking forward.

FIG. 1 shows a simplified schematic cross-sectional view of a conventional single-hull tanker taken through the midship cargo section. The midship cargo section of the tanker comprises port outer hull plating 20, starboard outer hull plating 22, a port longitudinal bulkhead 24, a starboard longitudinal bulkhead 26, bottom plating 28, and deck plating 30. The midship cargo section of the single-hull tanker of FIG. 1 thus includes a series of port wing tanks 21, starboard wing tanks 23 and central cargo tanks 25. The method of the invention is equally applicable to tankers also having central longitudinal bulkheads (not shown), thus defining port and starboard central tanks.

Figure 2:
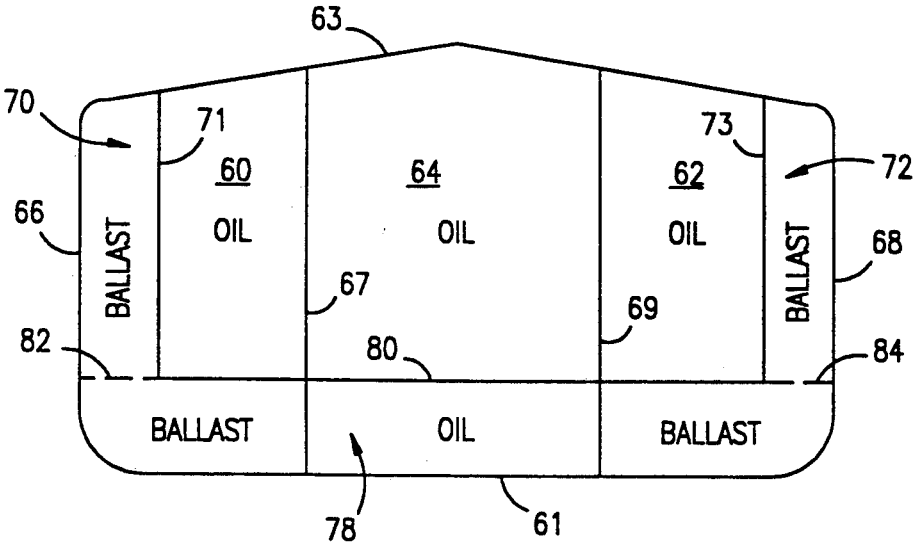
FIG. 2 is a similar view through a mid-deck tanker.

As also indicated above, FIG. 2 shows a comparable midships cross-sectional view of a conventional mid-deck tanker, including port outer plating 66, starboard outer plating 68, port longitudinal bulkhead 67, starboard longitudinal bulkhead 69, bottom plating 61 and deck plating 63. The mid-deck tanker of FIG. 2 further includes port outer longitudinal bulkhead 71, starboard outer longitudinal bulkhead 73, and a longitudinal mid-deck 80. Thus the mid-deck tanker of FIG. 2 includes port wing ballast tank 70, port wing cargo tank 60, upper central cargo tank 64, lower central cargo tank 78, starboard wing cargo tank 62 and starboard wing ballast tank 72. Mid-deck 80 may optionally be extended by perforated portions 82 and 84 to meet the port and starboard outer hull plating 66 and 68 respectively.

Figure 3:
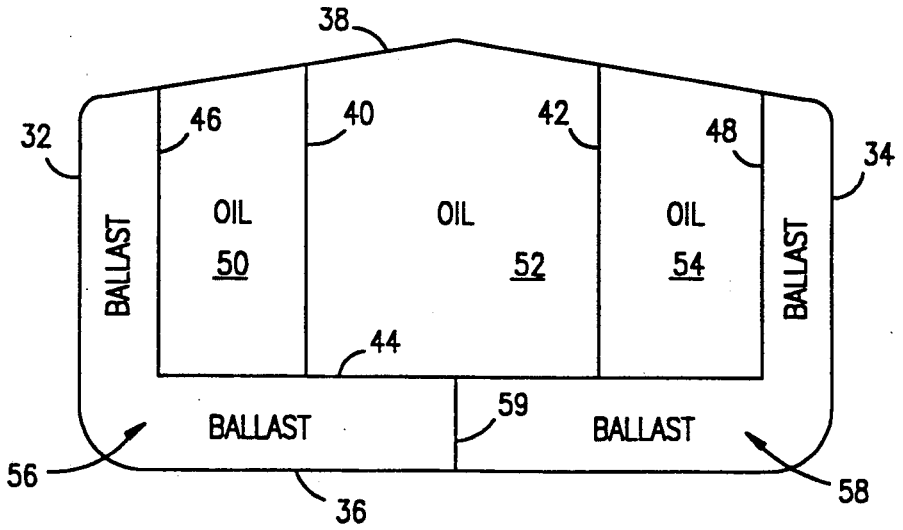
FIG. 3 is a similar view through a double-hulled tanker.

FIG. 3 depicts a similar view of a double-hulled tanker, comprising port outer hull plating 32, starboard outer hull plating 34, hull bottom plating 36, and deck plating 38. The double-hulled tanker of FIG. 3 includes an outer port ballast tank 56 and an outer starboard ballast tank 58 separated from one another by central longitudinal bulkhead 59 and from the cargo tanks 50, 52 and 54 by port outer longitudinal bulkhead 46, mid-deck 44 and starboard outer longitudinal bulkhead 48. Inner longitudinal bulkheads 40 and 42 separate wing tanks 50 and 54 from central cargo tank 52.

Figures 4, 5, 6, 7:
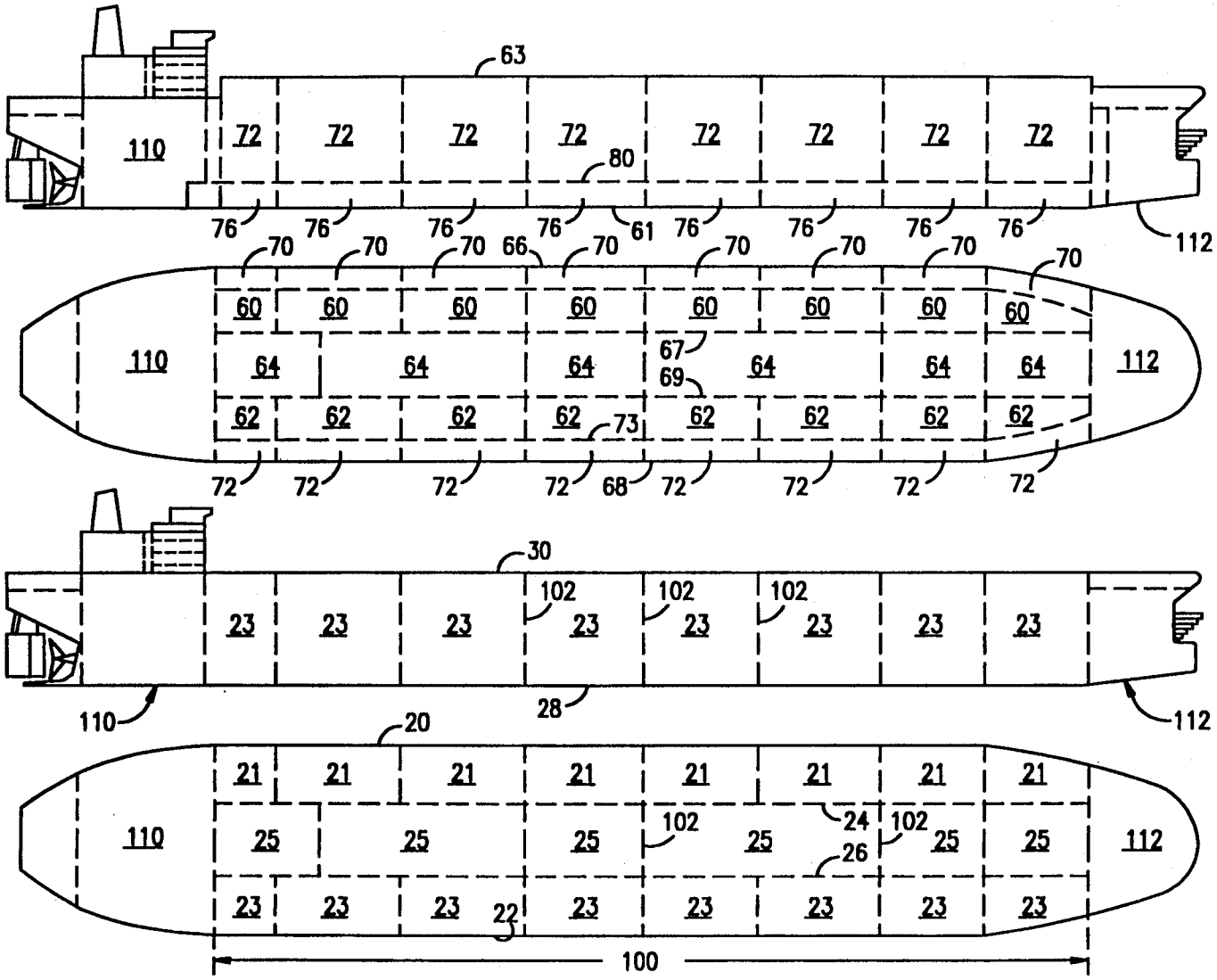
FIG. 4 is a simplified side elevation view of a conventional single-hull tanker, showing principal bulkheads and decks in dotted lines.
FIG. 5 is a simplified plan view of the single-hull tanker of FIG. 4, again showing principal bulkheads in dotted lines.
FIG. 6 is a view comparable to FIG. 4 of a mid-deck tanker having been reconfigured from a single deck tanker according to the invention.
FIG. 7 is a view comparable to FIG. 5 of the reconfigured mid-deck tanker of FIG. 6.

FIG. 4 shows a simplified side elevational view of a conventional single-hull tanker, while FIG. 5 shows a plan view of the single hull tanker. The tanker includes stern section 110, including control and propulsion equipment, crew quarters, and the like, bow section 112, and a midship cargo section 100, all as conventional. Interior bulkheads and decks in the midship section 100 are indicated by dotted lines. Longitudinal bulkheads 24 and 26 and transverse bulkheads 102 divide the midship cargo section 100 into a series of port wing cargo tanks 21, starboard wing cargo tanks 23 and central cargo tanks 25. As used herein, the term "transverse bulkheads" refers to imperforate bulkheads, that is, to solid steel sheet members physically separating one tank from the next. The tanker structure also typically includes perforated transverse members referred to hereinafter as "web frames". Such perforated transverse web frames add structural stiffness but do not prevent flow of the contents of a tank from one portion of the tank into the adjoining portion.

FIGS. 6 and 7 show views comparable to FIGS. 4 and 5 of a single-hull tanker having been reconfigured as a mid-deck tanker according to the invention. Again, longitudinal bulkheads 67 and 69 separate central cargo tanks 64 from port wing cargo tanks 60 and starboard wing cargo tanks 62. However, according to the preferred embodiment of the invention, additional outer port and starboard longitudinal bulkheads 71 and 73 respectively are added. Outer port longitudinal bulkhead 71 defines port wing ballast tanks 70 disposed between the port wing cargo tanks 60 and the port outer hull plating 66. Similarly, starboard outer longitudinal bulkhead 73 defines starboard wing ballast tanks 72 between the starboard wing cargo tanks 62 and the starboard outer hull plating 68. Further according to the preferred embodiment of the invention, a new mid-deck 80 is added, separating port wing cargo tanks 60 from port wing ballast tanks 70 and starboard wing cargo tanks 62 from starboard wing ballast tanks 72. See FIG. 2. As discussed above in connection with FIG. 2, perforated mid-deck plating may extend to the port and starboard outer hull plating 66 and 68. Otherwise, the wing ballast tanks defined by the structure added according to the method of the invention may extend continuously into the chines of the tanker.

Figure 8:
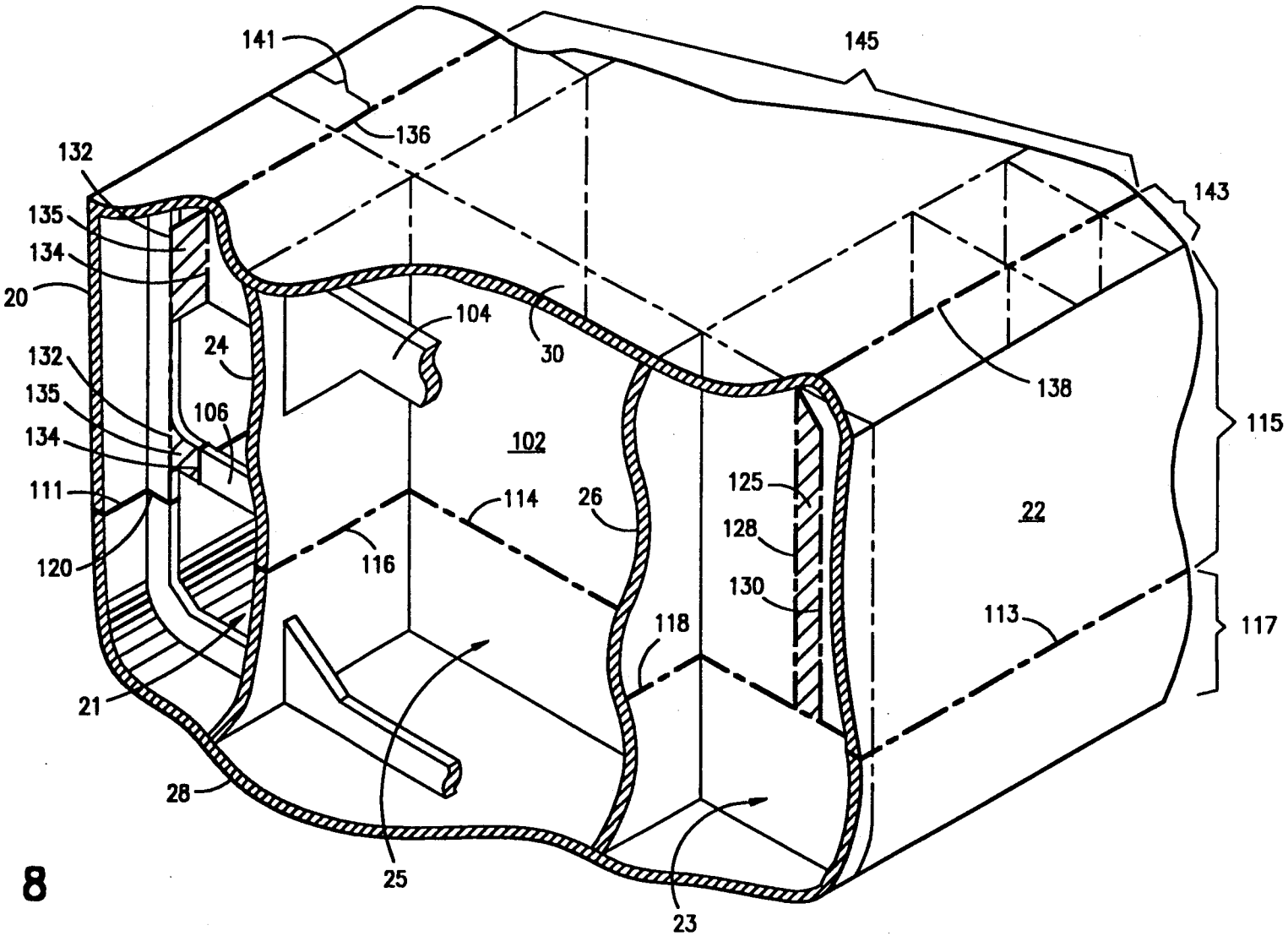
FIG. 8 is a partly cut-away perspective view of the midship cargo section of a conventional single-hull tanker, looking forward, showing cutting lines and structure removed in practice of the method of the invention.

FIG. 8 shows as mentioned above a cut-away perspective view of the midship cargo section of a conventional single-hull tanker. Dash-dot lines indicate the lines along which the structure of the midship cargo section of the tanker is cut in practice of the method of the invention. Accordingly, the structure shown in FIG. 8 includes deck plating 30, port hull plating 20, starboard hull plating 22, port longitudinal bulkhead 24, starboard longitudinal bulkhead 26, and bottom plating 28. The structure additionally includes continuous transverse bulkheads as indicated at 102, that is, imperforate steel sheet members extending transversely across the full breadth of the vessel and dividing the various tanks longitudinally from one another. Additional central transverse web frames 104 and wing tank web frames 106 are typically provided. For example, wing tank web frames 106 extend from port hull plating 20 to port longitudinal bulkhead 24. Central web frames 104 extend transversely between port and starboard longitudinal bulkheads 24 and 26, respectively. Web frames 104 and 106 are perforated, as shown, so as to stiffen the structure of the tanker without preventing flow of cargo or ballast longitudinally within the respective tanks.

FIG. 8 illustrates further that the port wing tanks 21 are defined between port outer hull plating 20, port longitudinal bulkhead 24, deck plating 30, bottom plating 28, and pairs of transverse bulkheads 102. Wing tank web frame 106 extends transversely across the port wing tank 21 to stiffen the structure in that region. Similarly the center tanks 25 are defined between port and starboard longitudinal bulkheads 24 and 26, respectively, deck plating 30, bottom plating 28, and pairs of transverse bulkheads 102. Central web frame 104 is provided to stiffen the structure of the vessel. The starboard wing tanks 23 are similarly defined by starboard longitudinal bulkhead 26, starboard outer plating 22, deck plating 30, bottom plating 28, and pairs of transverse bulkheads 102.

According to the invention, an additional mid-deck is added well below the tanker's laden water line, dividing the original wing tanks 21 and 23 into upper cargo and lower ballast portions, and similarly separating the center tanks 25 into upper and lower portions thereof. To permit insertion of a prefabricated mid-deck structure, the midship cargo section of the tanker is cut longitudinally along a horizontal plane, separating the midship cargo section into upper and lower sections 115 and 117 respectively. More specifically, the outer plating 20 and 22 is cut longitudinally along horizontal cut lines indicated by dot-dash cutting lines 111 and 113. The longitudinal bulkheads 24 and 26 are cut along horizontal dot-dash cutting lines 116 and 118. The transverse bulkheads are cut transversely along horizontal dot-dash lines 114. Web framing 106 is similarly cut on horizontal dot-dash cutting line 120. Thus, the midship cargo portion 100 of the vessel is divided into upper and lower portions 115 and 117 by cutting horizontally through all longitudinal or transverse structures. The upper portion 115 of the midship cargo section 100 of the tanker is also cut from the bow 112 and stern 110, to accomplish complete separation.

According to a further object of the invention, the port and starboard wing cargo tanks 21 and 23 respectively are also divided vertically by insertion of new longitudinal bulkheads, to form outer wing ballast tanks between the outer hull plating and inner wing cargo tanks. Preferably, additional longitudinal bulkhead structures are prefabricated for disposition between the port outer plating 20 and the port longitudinal bulkhead 24, and similarly between the starboard outer plating 22 and the starboard longitudinal bulkhead 26. To enable insertion of such prefabricated longitudinal bulkheads, each of the transverse bulkheads 102 is cut along pairs of parallel vertical cutting lines, indicated at 128 and 130 as to the starboard side of the transverse bulkheads. Scrap sections 125 of the transverse bulkheads 102, shown hatched diagonally in FIG. 8, are thus separated and are scrapped. Similarly, the wing tank web frames 106 are cut along vertical cutting lines 132 and 134. Scrap sections 135 of the web frame between cutting lines 132 and 134, again indicated by diagonal hatching, are similarly removed and scrapped. Conveniently, the deck plating 30 is cut along longitudinal dot-dash cutting lines 136 and 138, where one of the vertical cutting lines intersects the deck plating 30. The effect of the cutting operations described is to further separate outer lateral portions 141 and 143 of the midships port and starboard outer plating, respectively, together with associated sections of the transverse bulkheads and web frames, from the central section 145 of the upper portion 115 of the midship section 100 of the vessel. Sections 141 and 143 may then be set aside, and replaced after insertion of new structure including the new longitudinal bulkheads.

Thus, according to the method of the invention, the midship cargo section of the tanker 100 is cut longitudinally along a horizontal line well below the water line of the laden tanker to separate the midship cargo section 100 into upper and lower portions 115 and 117 respectively. The upper portion 115 is cut free from the bow and stern, and is cut lengthwise along vertical lines to separate the port and starboard outer hull plating structure 141 and 143 respectively from the center section 145 of the upper portion 115 of the midship section 100 of the tanker. The center section 145 of the upper portion 115 of the midship section 100 of the tanker is then elevated with respect to the lower portion 117 thereof, and a spacer member 142 (FIG. 9) including a new mid-deck 80 is inserted therebetween.

Figure 9:
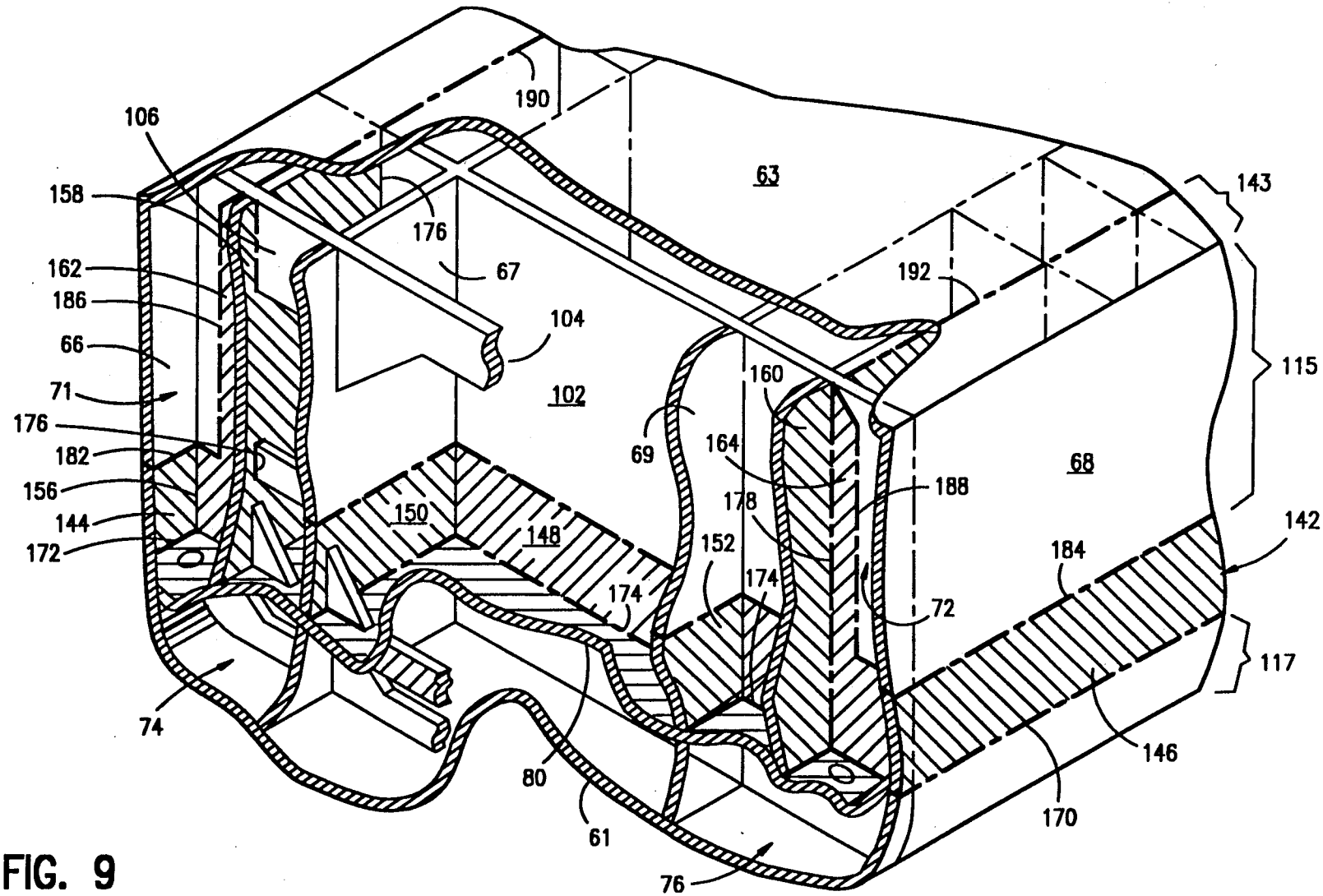
FIG. 9 is a view comparable to FIG. 8 of a single-hull tanker having been reconfigured as a mid-deck tanker according to the method of the present invention.

The spacer member 142 is shown hatched in FIG. 9. A horizontal portion of the spacer member 142 includes plating inserts 144 and 146 for the port outer hull plating and the starboard outer hull plating, respectively, transverse bulkhead inserts 148 for each of the transverse bulkheads 102, insert 150 for the port longitudinal bulkhead 67, a like insert 152 for the starboard longitudinal bulkhead 69, and web frame inserts 154 and 156 for the center web frames 104 and the wing web frames 106 respectively.

The new deck 80 separates upper and lower central cargo tanks 64 and 78. Deck 80 extends laterally outwardly to the hull, separating the wing cargo tanks 60 and 62 from the chine portions of ballast tanks 71 and 72. As shown, the laterally outermost portions 82 and 84 of deck 80 are perforated, connecting wing and chine portions of the ballast tanks. Alternatively, the laterally outermost portions 82 and 84 of deck 80 may be imperforate, fully separating chine ballast tanks 74 and 76 from wing ballast tanks 71 and 72.

The spacer member 142 may conveniently be supplied as a single fabrication comprising port and starboard vertical sections 167 and 169 respectively, including new outer port longitudinal bulkhead 158 and new outer starboard longitudinal bulkhead 160, and including inserts 164 for the transverse bulkheads 102 and inserts 162 for the web frames 106. That is, inserts 164 and 162 in effect replace the scrap sections 125 and 135 removed from the transverse bulkheads 102 and web frames 106 as discussed above in connection with FIG. 8. By supplying the new longitudinal bulkheads 158 and 160 together with inserts 162 and 164 for the web frames and bulkheads (as opposed to inserting separate longitudinal bulkhead members between each pair of transverse bulkheads 102) the spacer 142 may be substantially fabricated in advance, so that the tanker is out of service for a relatively short time. The new longitudinal bulkheads divide the wing cargo tanks into ballast tanks 71 and 72 and cargo tanks 60 and 62.

When the spacer member 142 has been set in place over the lower portion 117 of the midship cargo portion of the hull, the starboard outer hull plating is welded along lower welding line 170 to the lower edge of the spacer 142; similarly, the port outer hull plating is welded to the spacer 142 along weld line 172. The inserts 148, 150, 152, 154 and 156 described above are welded to the longitudinal and transverse bulkheads, and to the web frames. The new port and starboard longitudinal bulkheads 158 and 160 and the associated inserts 162 and 164 are put into place, if supplied separately from the horizontal section of the spacer member 142, and are welded to the transverse web frames and bulkheads along welding lines 176 and 178 corresponding to the cutting lines 134 and 128. The removed upper port and starboard portions 141 and 143 of the outer hull plating are then replaced, and are welded at their lower edges to the spacer 142 along weld lines 182 and 184 and to inserts 162 and 164 along welding lines 186 and 188 corresponding to the cutting lines 132 and 130. The deck plating is rewelded along weld lines 190 and 192. The bow and stern sections 112 and 110 are welded to the reconfigured midship section of the hull, completing the integrity of the hull.

Those of skill in the art are aware of the need for careful planning and execution of the steps involved in reconfiguration of a tanker according to the invention, including separating the midship cargo section of a tanker into upper and lower portions by cutting it along horizontal longitudinal lines, cutting the upper portion of the midship section free from the bow and stern of the tanker, cutting the separated upper portion along vertical longitudinal lines, removing the outer portions of the upper portion of the midship cargo section, elevating the center section of the upper portion of the midship cargo section, inserting a spacer section including a new mid-deck between the upper and lower portions of the midship section of the tanker, inserting new longitudinal bulkheads, and reassembling the tanker. The spacer member may be inserted in several portions; for example, it might be found convenient to place the horizontal portion of the spacer 142 including the new mid-deck 80 between the upper and lower portions of the midship cargo section of the tanker prior to assembling the vertical portions including new longitudinal bulkheads 158 and 160 to the horizontal portion of the spacer 142. Alternatively, the entire bow of the tanker might be removed from the midship cargo section; this would allow a complete spacer 142 including vertical portions incorporating new longitudinal bulkheads 158 and 160 to be slid between the upper and lower portions of the midship cargo section of the tanker.

The art is well aware of procedures for cutting apart a preexisting tanker and inserting new hull sections, involving techniques generally comparable to those required for practice of the present invention. It is commonplace to cut conventional tankers transversely and along horizontal longitudinal lines and simultaneously deepen and lengthen their midship cargo sections, and also to cut tankers apart lengthwise to insert new longitudinal midship cargo sections. Essentially similar techniques as required to practice the method of the present invention are considered to be within the skill of the art. Similarly, revision of the vessel's cargo and ballast piping to allow suitable flow of oil and water into its various tanks, and of its wiring and control systems, are within the skill of the art.

Figure 11:
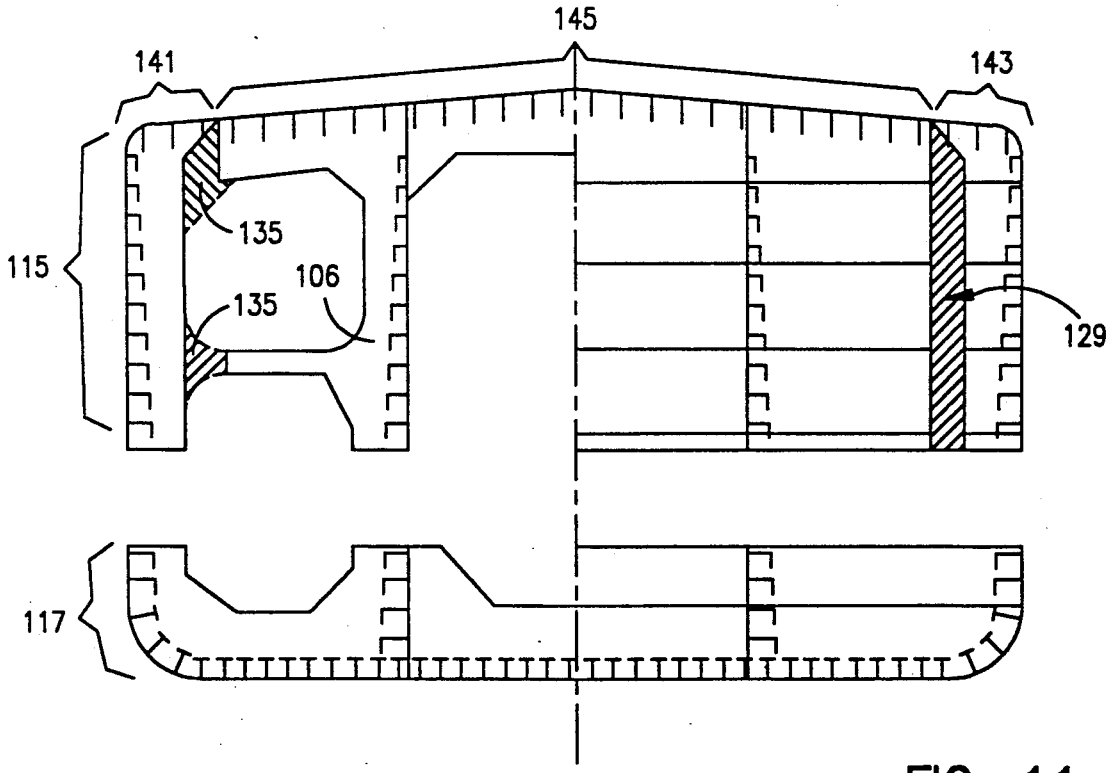
FIG. 11 is a view comparable to FIG. 10, showing the manner whereby the midship cargo section of a single-hull tanker is cut apart and structure removed according to the method of the invention.
Figure 12:
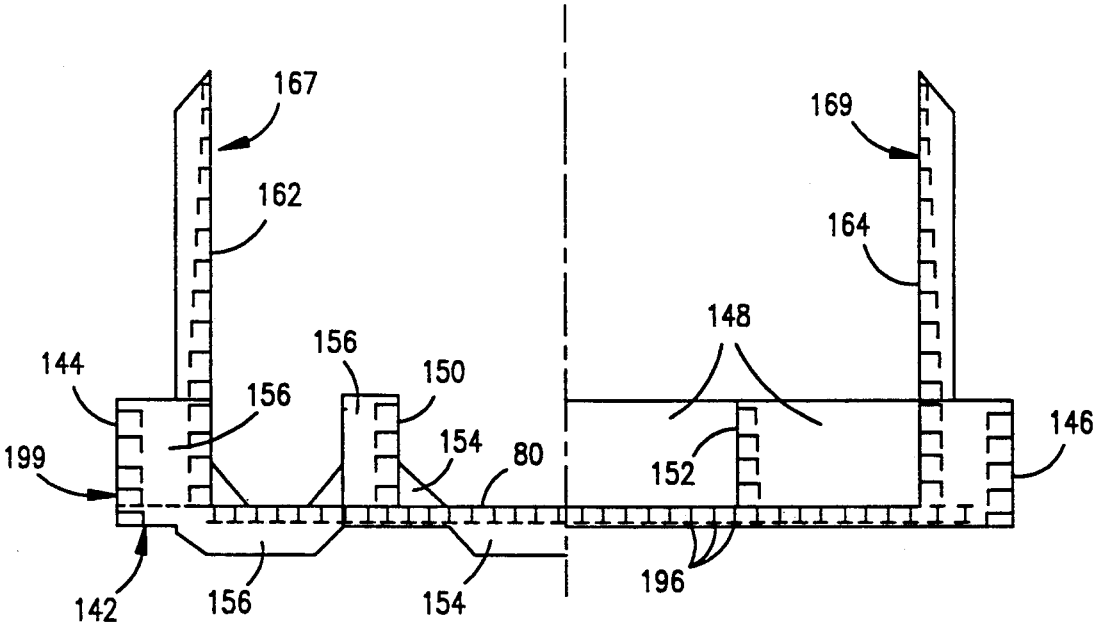
FIG. 12 is a view comparable to FIG. 10, showing new structure added to a single-hull tanker according to the invention.
Figure 13:
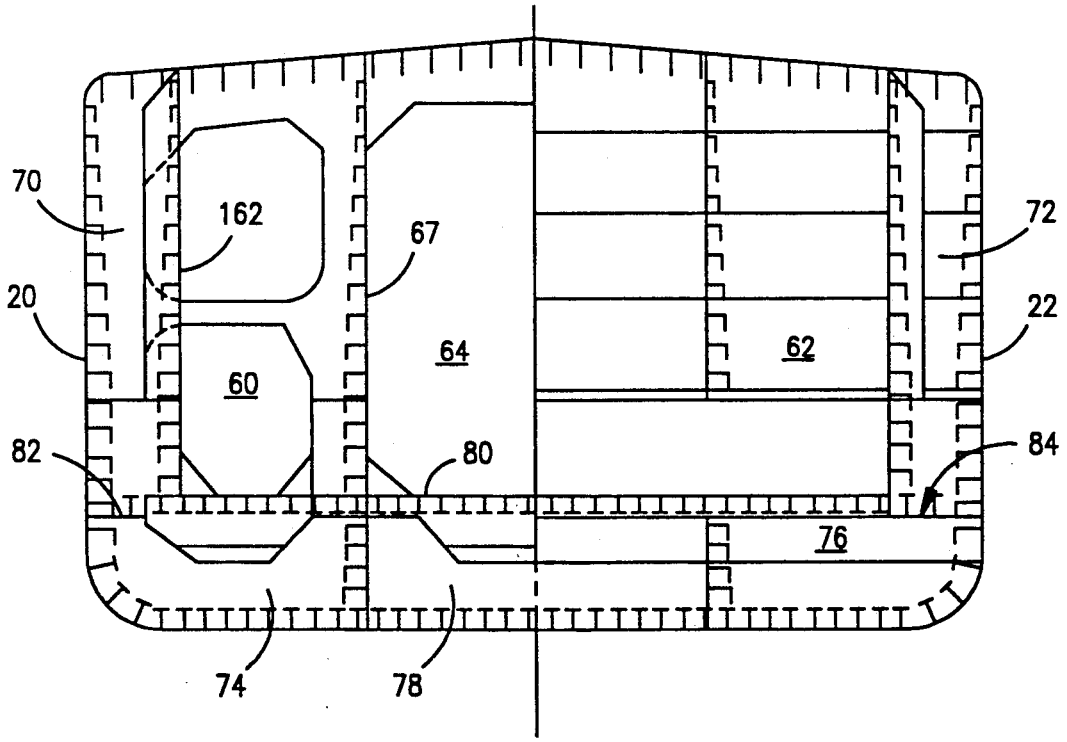
FIG. 13 is a view comparable to FIG. 10, showing a single-hull tanker having been reconfigured according to the invention as a mid-deck tanker by addition of the structure shown in FIG. 12 to the single-hull tanker cut apart as shown in FIG. 11.

FIGS. 10, 11, 12 and 13 show simplified cross-sectional views of the midship cargo section of the tanker, each looking forward, and showing the configuration of the tanker prior to being cut apart (FIG. 10), the manner in which the tanker is cut apart and separated (FIG. 11), the spacer member which is inserted (FIG. 12), and the reconfigured mid-deck tanker (FIG. 13). The left half of each of FIGS. 10–13 is a section aft of a typical web frame while the right half is a section aft of a transverse bulkhead. FIGS. 10–13 additionally show schematically the placement of longitudinal stiffening stringers indicated generally at 196; such longitudinal stringers 196 are typically attached as shown to each of the longitudinal bulkheads and decks, and to the hull plating.

Figure 10:
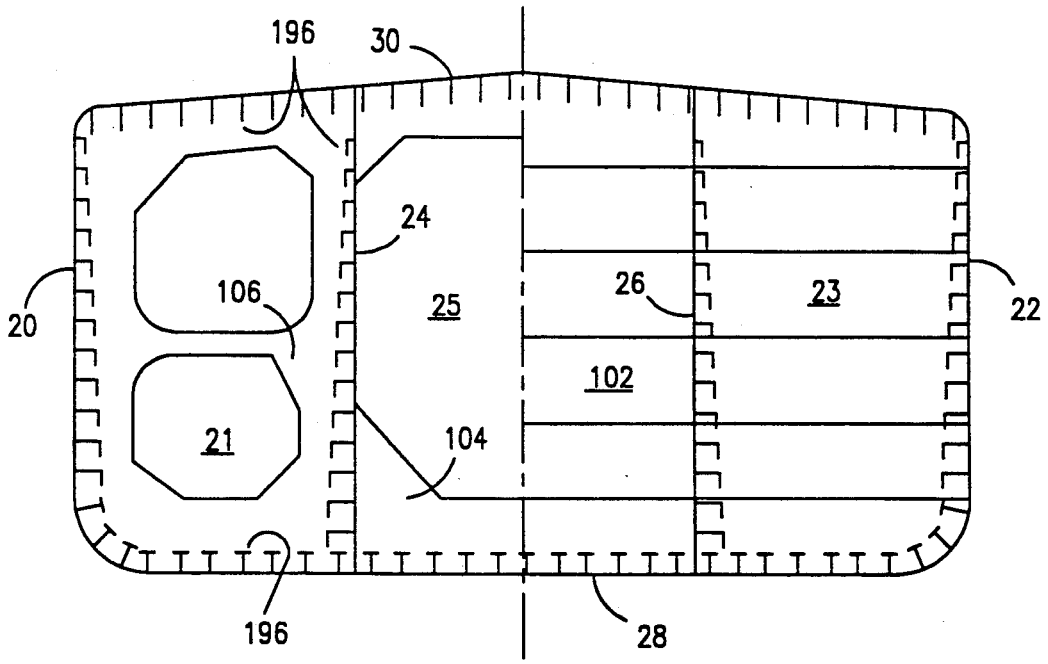
FIG. 10 is a schematic cross-sectional view of the midship cargo section of a single hull tanker, looking forward, the left side of FIG. 10 being a view at a web frame and the right side a view at a transverse bulkhead.

Thus in FIG. 10 the single-hull tanker is shown comprising port outer plating 20, starboard outer plating 22, deck plating 30, hull bottom plating 28, longitudinal bulkheads 24 and 26, transverse bulkhead 102, web frame 106 in the port wing tank 21, and web frame 104 in the center tank 25.

FIG. 11 depicts the manner in which the midship cargo section of the tanker is cut along a horizontal plane, separating the midship cargo section 100 into an upper portion 115 and a lower portion 117. FIG. 11 also shows the manner in which the transverse bulkheads 102 and wing tank web frames 106 are cut vertically, to remove hatched scrap sections 125 from each of the transverse bulkheads 102 and hatched scrap sections 135 from each of the wing tank web frames 106. The port and starboard outer hull plating sections 141 and 143 are thus separated, together with the outer portions of the transverse bulkheads 102 and web frames 106, from a central portion 145 of the upper portion 115 of the midship section 100 of the tanker. The removed hatched sections 135 of the web frames 106 are scrapped, as are the sections 125 removed from the transverse bulkheads 102. The removal of these scrap sections makes way for assembly of the new longitudinal bulkheads added according to the method of the invention.

FIG. 12 shows the spacer member 142 interposed between the central portion 145 of the upper portion 115 of the midship cargo portion 100 and lower portion 117. As indicated above in connection with FIG. 9, the spacer member 142 may be supplied as a single fabrication including a horizontal section 147 including insert 144 for the port outer hull plating, insert 146 for the starboard outer hull plating, inserts 150 and 152 for the longitudinal bulkheads, new mid-deck 80, and port and starboard vertical sections 167 and 169, including new longitudinal bulkheads 162 and 164 respectively. Spacer 142 also includes inserts 148 for the transverse bulkheads and inserts 154 and 156 for the web frames. As shown, stringers 196 stiffening the new mid-deck 80 substantially coincide with the lower edge of the inserts 148 for the transverse bulkheads.

FIG. 13 shows the configuration of the tanker's midship cargo section 100 after reconfiguration according to the invention. New port ballast tank 70 is defined between the port outer hull plating 20 and the new inner port longitudinal bulkhead 162; see also FIG. 9. The port wing cargo tank 60 then extends between the new port longitudinal bulkhead 162 and the original longitudinal bulkhead 67. The center cargo tank is divided into an upper section 64 and a lower section 78 by the new mid-deck 80. Mid-deck 80 also separates the port and starboard wing cargo tanks 60 and 62 respectively from the corresponding chine portions of the ballast tanks. As discussed above, mid-deck 80 may be extended to the port outer plating 20 by addition of perforated sections 82 and 84. Such sections 82 and 84 might be made imperforate, if it were desired to separate the wing ballast tanks 70 and 72 from respective chine ballast tanks 74 and 76. As shown in FIG. 13, the weld lines along which the spacer is welded to the retained portions of the midship cargo section of the tanker essentially coincide with the cutting lines along which the midship cargo section of the tanker was cut apart.

As also noted above, the lower central cargo tank 78 may be converted to a ballast tank in the event that world shipping regulations or the like make employment of double-bottomed tankers imperative for oceanic shipment of oil.

It will be appreciated that according to the invention a method for reconfiguring a single-hull tanker as a mid-deck tanker has been described. According to the method of the invention, a conventional single hull tanker may be reconfigured as a mid-deck tanker having port and starboard wing ballast tanks outboard of port and starboard wing cargo tanks. The additional ballast tanks space the cargo tanks from the hull of the vessel, protecting against oil spillage in the event of damage to the sides and/or chines of the vessel due to collision or grounding damage. Some 80% of the outer plating of a typical vessel having been reconfigured according to the invention forms the skin of a ballast tank. Moreover, according to the invention the central cargo tank is divided into upper and lower portions. While the lower central tank remains single-hulled, its capacity and hence its potential for spillage is reduced substantially by the presence of mid-deck 80. Further, in the event it becomes imperative to employ double-hulled tankers for oil transport, the lower cargo tank 78 may be converted to a ballast tank, thus providing a double-hulled tanker at a fraction of the cost of construction of a new tanker.

The relative proportions of the tanker prior to and after conversion will vary from vessel to vessel and are not critical to the practice of the invention. It has been calculated by the inventors that a conventional tanker of some 285,000 metric tons deadweight can be converted to a mid-deck tanker according to the invention at no change in its principal particulars, other than its depth increasing from 28 meters to 34 meters and its laden draft from 21.8 to 22.4 meters. In this example, the horizontal plane along which the upper and lower portions of the midship cargo section were separated was assumed to be made at approximately quarter depth, that is, at a height above the keel approximately one-quarter of the distance from the keel to the deck. The vertical cuts, along which the new longitudinal bulkheads lie, were taken to be approximately 5 meters inboard of the port and starboard outer hull sides. The cost of the conversion is estimated to be attractive with respect to the cost of construction of a new double-hulled tanker of comparable capacity; obviously the economics of conversion of any particular tanker will vary, particularly in dependence on the anticipated useful life of the converted tanker.

Therefore while a preferred embodiment of the method of the invention has been discussed in detail, the details of the particular embodiment described should not be considered as limiting of the invention, but merely as exemplary thereof. The method of the invention is therefore to be limited only by the following claims.

What is claimed is:

1. A method of reconstructing a tanker having a bow section, a stern section, and a midship cargo section, said midship cargo section including hull bottom plating, deck plating, port and starboard outer plating, continuous port and starboard longitudinal bulkheads, and a plurality of continuous transverse bulkheads, whereby a plurality of center cargo tanks are formed between said port and starboard longitudinal bulkheads, said transverse bulkheads, and said bottom and deck plating, a plurality of port wing cargo tanks are formed between said port outer plating, said port longitudinal bulkhead, said transverse bulkheads, and said bottom and deck plating, and a plurality of starboard wing cargo tanks are formed between said starboard outer plating, said starboard longitudinal bulkhead, said transverse bulkhead, and said bottom deck plating, said method comprising the steps of:

(1) separating a lower portion of the midship cargo section from an upper portion thereof by:

(a) cutting said port and starboard outer plating apart along horizontal cutting lines extending the length of said midship cargo section;

(b) cutting said continuous port and starboard longitudinal bulkheads apart along horizontal cutting lines extending the length of said midship cargo section; and (c) cutting each of said continuous transverse bulkheads apart along horizontal cutting lines extending transversely across said midship cargo section;

(2) cutting said bow and stern sections free from said upper portion of the midship cargo section, and elevating said upper portion of said midship cargo section with respect to said lower portion thereof;

(3) inserting a spacer member between said separated upper and lower portions of said midship cargo section, said spacer member including new insert sections of said port and starboard outer hull plating, of said port and starboard longitudinal bulkheads, and of said transverse bulkheads, said spacer member further including a new horizontal mid-deck;

(4) welding said separated lower portion of the midship cargo section to a lower longitudinal edge of said spacer member, and said separated upper portion of the midship cargo section to an upper longitudinal edge of said spacer member; and (5) welding said upper portion of said midship cargo section to said bow and stern.

2. The method of claim 1, wherein said horizontal cutting lines along which said port and starboard outer plating, said port and starboard longitudinal bulkheads, and said transverse bulkheads are cut apart lie substantially in a horizontal plane.

3. The method of claim 2, wherein said horizontal plane is substantially below the laden waterline of said tanker.

4. The method of claim 3, wherein said new mid-deck is provided with longitudinal stiffening members disposed below the lower edge of said spacer member.

5. The method of claim 1, comprising the further step of assembling new port and starboard vertical longitudinal bulkheads between each of said transverse bulkheads, said new longitudinal bulkheads being located between said new mid-deck and said deck plating, and between said outer plating and said continuous longitudinal bulkheads, thereby dividing said wing tanks vertically in two, forming laterally inner port and starboard wing cargo tanks and laterally outer port and starboard ballast tanks.

6. The method of claim 5, wherein said new mid-deck extends between said insert sections for said port and starboard outer plating, and wherein at least a center section of said mid-deck extending between said new port and starboard vertical longitudinal bulkheads is imperforate, whereby said laterally inner wing cargo tanks are separated from chine portions of said ballast tanks and said central cargo tanks are divided into upper and lower portions by said new mid-deck.

7. The method of claim 5, wherein said step of assembling new vertical longitudinal bulkheads includes the steps of:

(a)(1) cutting each said transverse bulkhead along two pairs of vertical cutting lines, one pair of cutting lines being disposed between each of the port and starboard outer plating and the corresponding longitudinal bulkhead, at least one of each said pair of vertical cutting lines extending vertically upwardly to intersect said deck plating, said pairs of vertical cutting lines extending downwardly to intersect horizontal cutting lines extending across the transverse bulkheads, and said pairs of vertical cutting lines being joined by cutting lines at upper extremities thereof, whereby cutting lines extend continuously along the entire periphery of port and starboard scrap sections of each transverse bulkhead, and (2) cutting said deck plating longitudinally along two parallel lines extending the length of said midship cargo section, said parallel lines along which said deck plating is cut longitudinally coinciding with the intersection with said deck plating of said at least one of each of said pairs of vertical cutting lines, whereby outer portions of the port and starboard outer plating are separated from a central portion of the upper portion of the midship cargo section;

(b) removing said separated outer portions of the port and starboard outer plating;

(c) removing said port and starboard scrap sections of each transverse bulkhead;

(d) inserting vertical spacer members on either lateral side of said central portion of said upper portion of said midship cargo section, said vertical spacer members each comprising one of said new vertical longitudinal bulkheads, and inserts replacing said port and starboard scrap sections removed from each transverse bulkhead;

(e) welding said vertical spacer members to said transverse bulkheads along weld lines substantially corresponding to laterally inward lines of said pairs of vertical cutting lines;

(f) replacing the removed outer portions of said port and starboard outer plating; and (g) welding said replaced outer portions of said port and starboard outer plating to said vertical spacer members along weld lines substantially corresponding to laterally outward lines of said pairs of vertical cutting lines.

8. The method of claim 7, wherein said midship cargo section further includes transverse wing tank web frames extending between the port and starboard outer plating and the corresponding longitudinal bulkheads, and wherein in said claim 7 step (a)(1) said web frames are cut along pairs of lines corresponding substantially to said pairs of vertical cutting lines, in claim 7 step (c) continuous sections of said web frames are removed, said vertical spacing members inserted in claim 7 step (d) include inserts replacing the continuous sections removed from said web frames, and in claim 7 step (e) remaining portions of said web frames are welded to said inserts.

9. The method of claim 1, wherein said midship cargo section further includes transverse web frames extending between the port and starboard outer plating and the corresponding longitudinal bulkheads, and between the longitudinal bulkheads, and wherein said step (1)(c) includes the step of cutting said transverse web frames along horizontal lines extending transversely across said midship cargo sections, wherein said step (3) of inserting a spacer member includes the step of inserting inserts between said separated portions of said web frames, and wherein said step (4) includes the step of welding lower and upper portions of said separated web frames to corresponding portions of said inserts inserted therebetween.

10. A method of reconstructing a tanker having a bow section, a stern section, and a midship cargo section, said midship cargo section including hull bottom plating, deck plating, port and starboard outer plating, continuous port and starboard longitudinal bulkheads, and a plurality of continuous transverse bulkheads, whereby a plurality of center cargo tanks are formed between said port and starboard longitudinal bulkheads, said transverse bulkheads, said bottom plating, and said deck plating, a plurality of port wing cargo tanks are formed between said port outer plating, said port longitudinal bulkhead, said transverse bulkheads, said bottom plating, and said deck plating, and a plurality of starboard wing cargo tanks are formed between said starboard outer plating, said starboard longitudinal bulkhead, said transverse bulkheads, said bottom plating, and said deck plating, said method comprising the steps of:

(1) separating a lower portion of said midship cargo section from an upper portion thereof by:

(a) cutting each of said port and starboard outer plating along horizontal cutting lines extending the length of said midship cargo section;

(b) cutting each of said continuous port and starboard longitudinal bulkheads along horizontal cutting lines extending the length of said midship cargo section; and (c) cutting each of said continuous transverse bulkheads along horizontal cutting lines extending transversely across said midship cargo section;

(2) cutting said bow and stern free from the upper portion of the midship cargo section;

(3) (a) cutting each said transverse bulkhead along two pairs of vertical cutting lines, one pair of said cutting lines being disposed between each of said port and starboard outer plating and the corresponding longitudinal bulkhead, at least one of each pair of vertical cutting lines extending vertically upwardly to intersect said deck plating, said pairs of vertical cutting lines extending downwardly to intersect said horizontal cutting lines extending across said transverse bulkheads, and said pairs of vertical cutting lines being joined by cutting lines at upper extremities thereof, whereby a continuous cutting line extends along the entire periphery of port and starboard scrap sections of each transverse bulkhead; and (b) cutting said deck plating longitudinally along two parallel lines extending the length of said midship cargo section, said two parallel lines along which said deck plating is cut longitudinally coinciding with the intersection with said deck plating of said at least one of each of said pairs of vertical cutting lines, whereby portions of said port and starboard outer plating are separated from said central portion of said upper portion of said midship cargo section;

(4) removing said separated portions of the port and starboard outer plating;

(5) removing said port and starboard scrap sections of each transverse bulkhead;

(6) inserting a horizontal spacer member between said upper and lower portions of said midship cargo section, said horizontal spacer member including a new mid-deck, and insert sections for said port and starboard outer plating, port and starboard longitudinal bulkheads, and for said transverse bulkheads;

(7) inserting vertical spacer members on either lateral side of the central portion of the upper portion of the midship cargo section, said vertical spacer members each including a new vertical longitudinal bulkhead and inserts replacing said port and starboard scrap sections removed from each transverse bulkhead;

(8) welding said vertical spacer members to the transverse bulkheads along weld lines substantially corresponding to laterally inward lines of said pairs of vertical cutting lines;

(9) welding said separated lower portion of the midship cargo section to port and starboard lower longitudinal edges of said horizontal spacer member, and said separated upper portion of the midship cargo section to upper edges of said horizontal spacer member;

(10) replacing said removed outer portions of the port and starboard outer plating; and

(11) welding said replaced outer portions of the port and starboard outer plating to said vertical spacer members along weld lines substantially corresponding to laterally outward lines of said pairs of vertical cutting lines, and to said insert sections for said port and starboard outer plating of said spacer member.

11. The method of claim 10, wherein said midship cargo section further includes transverse wing tank web frames extending between said port and starboard outer plating and the corresponding longitudinal bulkheads, and central web frames extending between said longitudinal bulkheads, and wherein said step (1)(c) includes the step of cutting said transverse wing tank and central web frames along horizontal lines extending transversely across said midship cargo section, wherein said step (3)(a) includes the step of cutting said wing tank web frames along vertical cutting lines corresponding to said vertical cutting lines along which said transverse bulkheads are cut, separating scrap sections of said web frames, and wherein said vertical spacer members inserted in step (7) include insert sections for replacing said scrap sections of said web frames, and wherein said step (8) includes the step of welding the separated web frames to corresponding insert sections of the vertical spacer members.

12. The method of claim 10, comprising the further step of fabricating said spacer members inserted in step (6) and said vertical spacer members inserted in step (7) as a single fabrication.

13. The method of claim 10, wherein one of the stern or bow sections of the tanker is separated from the midship cargo section after step (2) but prior to said step (6).

14. The method of claim 10, wherein said new mid-deck extends between said insert sections for said port and starboard outer plating, and wherein at least a center section of said mid-deck extending between said new port and starboard vertical longitudinal bulkheads is imperforate, whereby laterally inner wing cargo tanks are separated from chine portions of laterally outer ballast tanks and said central cargo tanks are divided into upper and lower portions by said new mid-deck.

* * * * *